US008540096B1

(12) United States Patent
Robbins, III

(10) Patent No.: US 8,540,096 B1
(45) Date of Patent: Sep. 24, 2013

(54) BOTTLE WITH RECESSED MOVABLE HANDLE

(75) Inventor: Edward S. Robbins, III, Muscle Shoals, AL (US)

(73) Assignee: Edward S. Robbins, III, Muscle Shoals, AL (US)

( * ) Notice: Subject to any disclaimer, the term of this patent is extended or adjusted under 35 U.S.C. 154(b) by 0 days.

(21) Appl. No.: 13/595,739

(22) Filed: Aug. 27, 2012

(51) Int. Cl.
*B65D 23/10* (2006.01)
*B65D 25/28* (2006.01)

(52) U.S. Cl.
USPC ..... 215/396; 215/384; 220/761; 220/770

(58) Field of Classification Search
USPC ..... 215/396, 398, 384; 220/761, 770, 220/772, 767, 752; 16/409, 410
See application file for complete search history.

(56) References Cited

U.S. PATENT DOCUMENTS 2,009,192 A * 7/1935 Freysinger ..... 383/14
3,491,913 A * 1/1970 Giraudet et al. ..... 220/801
4,915,241 A * 4/1990 Morimura et al. ..... 215/398
4,923,082 A * 5/1990 Bird ..... 220/737
5,002,193 A * 3/1991 Touzani ..... 215/396
5,647,624 A * 7/1997 Beshara, Jr. ..... 294/27.1
5,988,418 A * 11/1999 Maeshima ..... 215/396
6,003,703 A * 12/1999 Ruggeri et al. ..... 215/396
7,805,886 B2 * 10/2010 Brandstatter ..... 47/75

* cited by examiner

*Primary Examiner* — Mickey Yu
*Assistant Examiner* — Niki Eloshway
(74) *Attorney, Agent, or Firm* — Brinks Hofer Gilson & Lione

(57) ABSTRACT

A container has a bottle enclosing a prescribed volume having a sidewall including a pair of recesses situated on opposite sides of a vertical midline, with at least one passage extending between the pair of recesses. A handle has first and second portions adapted to be received wholly within the pair of recesses in the sidewall. Connecting portions extend through the passage in a portion of the sidewall to connect the first and second handle portions to each other. The connecting portions include a hinge permitting the first and second portions to be displaced from within the sidewall recesses to a position projecting outward from the sidewall sufficiently to permit the first and second portions to be grasped in one hand by a user of the container.

13 Claims, 11 Drawing Sheets

BOTTLE WITH RECESSED MOVABLE HANDLE

BACKGROUND

This invention relates to containers formed of integral one-piece plastic bottles suitable for use in the distribution of milk, water, carbonated and non-carbonated beverages, other liquids and free-flowing particulates, the containers including a handle that is movable between recesses in the sidewall of the container and an extended position protruding beyond the sidewall of the container.

Containers for flowable products, such as liquids and granular products, have been formed of plastic by a variety of methods. For example, plastic containers have been molded to form an integral container body, neck finish and handle. Other plastic containers have been formed with an integral container body and neck finish, and a separate handle later attached to the container body after removal from the blow mold. Still other plastic containers have been formed by positioning an integral handle and neck finish in a blow mold, whereby during blowing of the container body (from a separate preform placed in the blow mold) the handle and the neck finish become attached to the container body. The blow molding process can include both extrusion-blow molding and injection-blow molding. Some containers have used a different plastic material for the handle than for the container body for reasons such as strength, color, aesthetics or cost. Some containers have also provided a separate handle that is attachable post-mold to the formed container.

Little attention has been paid to considering the formation of such containers to allow for a change between a compact conformation during shipping and storage, and a more user-friendly expanded conformation during use by the end consumer. What is needed is a container having handles that can be stored in a non-extending manner and, when needed by the consumer, deployed for easy handling of the container.

SUMMARY

In one embodiment, a container can be a bottle enclosing a prescribed volume. The bottle can include a base, a sidewall extending upward from the base, a shoulder extending upward and inward from the sidewall to a finish surrounding an opening into the bottle, the finish being adapted to receive a closure. The sidewall can include a pair of recesses situated on opposite sides of a vertical midline, with at least one passage extending between the pair of recesses. The container can also include a handle having first and second portions adapted to be received wholly within the pair of recesses in the sidewall. Connecting portions can extend through the at least one passage to connect the first and second handle portions to each other. The connecting portions can include a hinge permitting the first and second portions to be displaced from within the sidewall recesses to a position projecting outward from the sidewall sufficiently to permit the first and second portions to be grasped in one hand by a user of the container.

In a particular embodiment, the at least one passage between the pair of recesses can be formed by a pinch-mold portion that defines a seam surrounding the passage generally in alignment with a parting line of the mold. This process is particularly useful for containers formed by an extrusion-blow molding process of polymers adapted to such processing.

In another embodiment, the at least one passage between the pair of recesses can be formed by a dowel or rod extending between two halves of a mold, the polymer forming the sidewall of the bottle wrapping around the dowel or rod, which is withdrawn from the passage during the parting of the mold after formation of the bottle. This process is particularly useful for containers formed by injection-blow molding processes of polymers adapted to such processing.

In a preferred embodiment, at least two passages are formed between the pair of recesses so that two connecting portions join the first and second handle portions to provide enhanced strength and better control of the container during use. The first and second handle portions and connecting portion can be formed of polymer that is different than that forming the bottle.

Other features of the present containers and the corresponding advantages of those features will be come apparent from the following discussion of preferred embodiments, which are illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
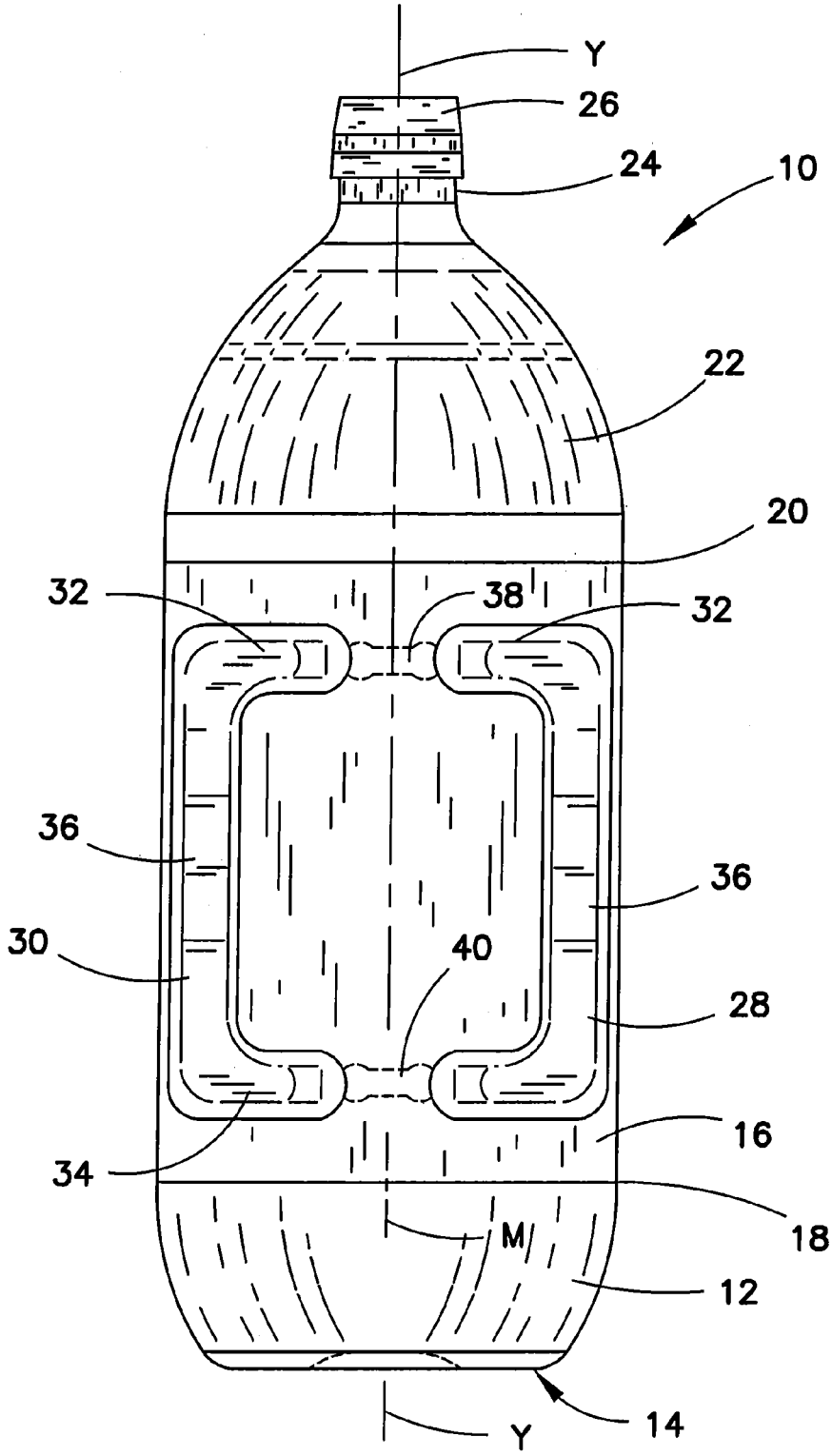
FIG. 1 is a front elevation view of a bottle including recesses adapted to receive handle portions.
Figure 2:
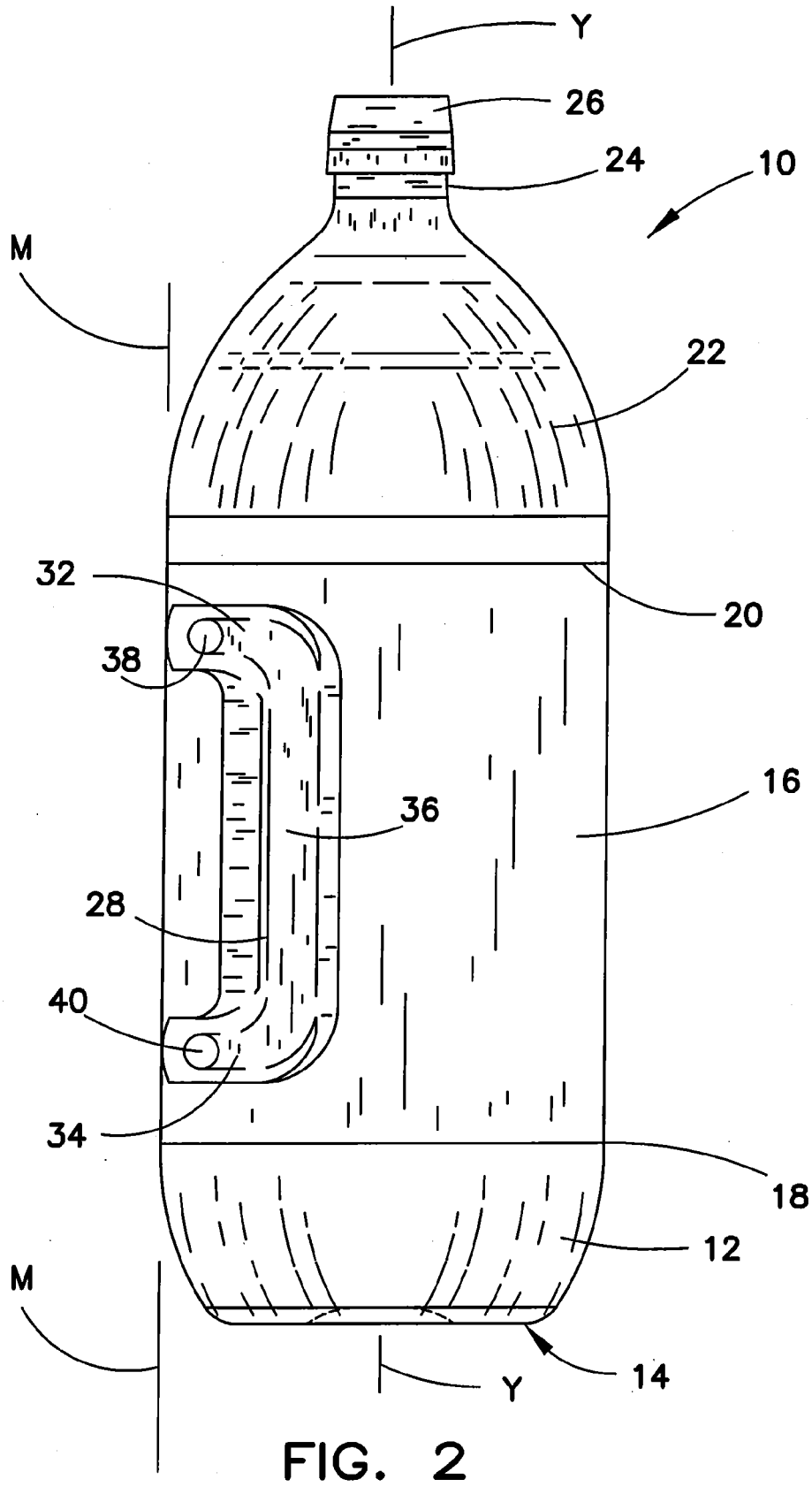
FIG. 2 is a side elevation view of the bottle of FIG. 1 showing a passage extending between the recesses.
Figure 3:
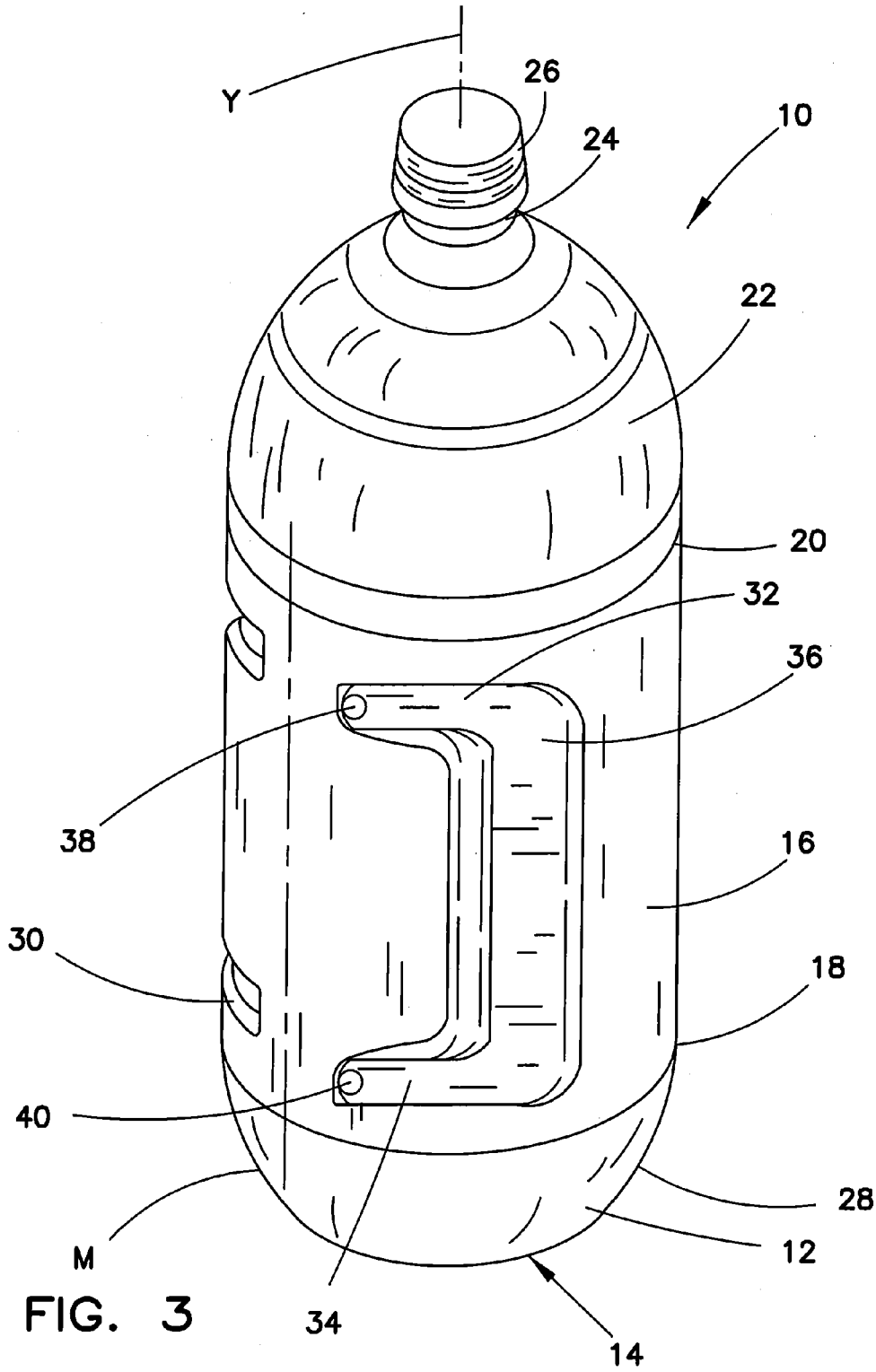
FIG. 3 is a perspective view of the bottle of FIGS. 1 and 2.

A bottle 10 is shown in FIGS. 1-3 that can be used in a container of the present invention. The bottle 10 can include a base 12. While the base 12 is illustrated to have an essentially planar bottom 14, the base 12 can be a petaloid bottom formed with a plurality of feet, or a champagne style bottom formed with a seating ring surrounding a centrally located, upwardly projected dome. A sidewall 16 can extend upward from the base 12. The sidewall 16 can include a lower margin 18 that is continuously joined to the base 12, and an upper margin 20. While the upper and lower margins 18 and 20 of sidewall 16 are shown to be circular, so that the sidewall is generally cylindrical, other shapes are also possible including triangular, ovate, rectangular, etc. A shoulder 22 can be continuously joined to the sidewall upper margin 20 to extend upward and inward from the sidewall 16 to a finish 24 surrounding an opening into the bottle 10. The finish 24 can be threaded or otherwise adapted to receive a closure 26.

The sidewall 16 can additionally include a pair of recesses 28, 30 situated on opposite sides of a midline M, which can be vertical and arranged parallel to an axis Y of the bottle 10. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 10 is molded. The passages 38, 40 can be completely surrounded or only partially surrounded by the plastic forming the sidewall 16 of the bottle 10. The illustrated bottle 10 can be formed by a conventional injection-blow molding process using polyethylene terephthalate (PET) or other suitable resin. The volume of the bottle 10 can selected over a range of volumes, but the utility of the container will become particularly apparent in bottles having a volume of 2 liters and greater.

Figure 4:
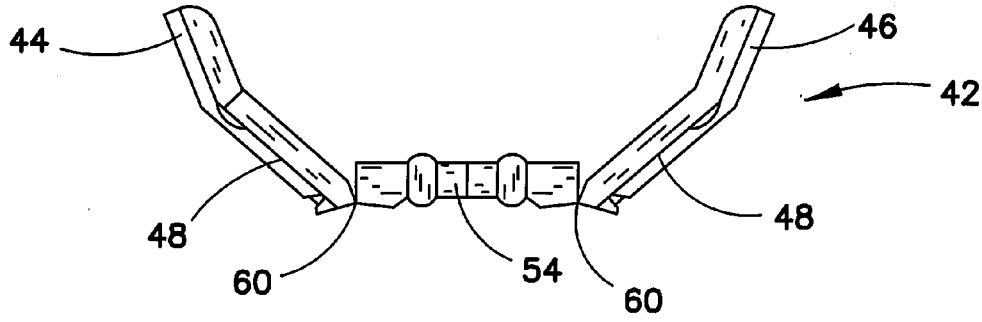
FIG. 4 is a top elevation view of a handle adapted to be coupled to the bottle of the previous FIGs.
Figure 5:
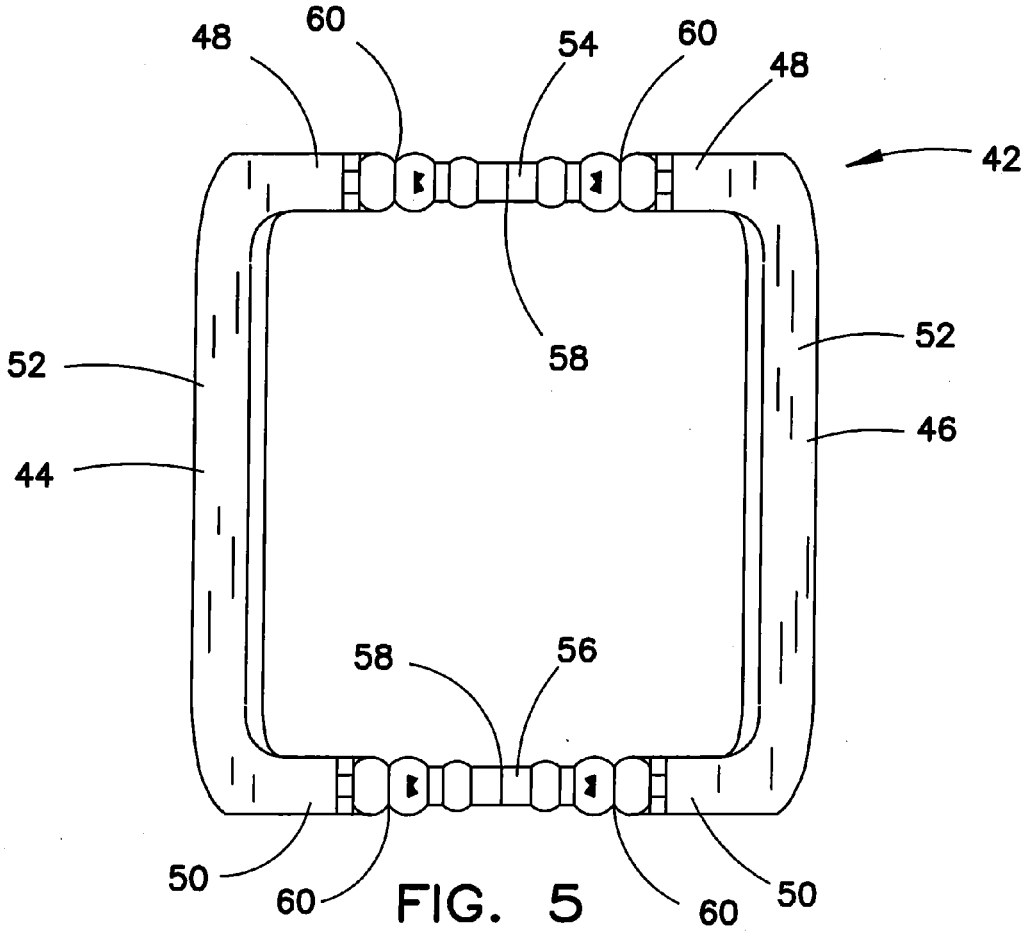
FIG. 5 is a front elevation view of a handle adapted to be coupled to the bottle of the previous FIGs.
Figure 6:
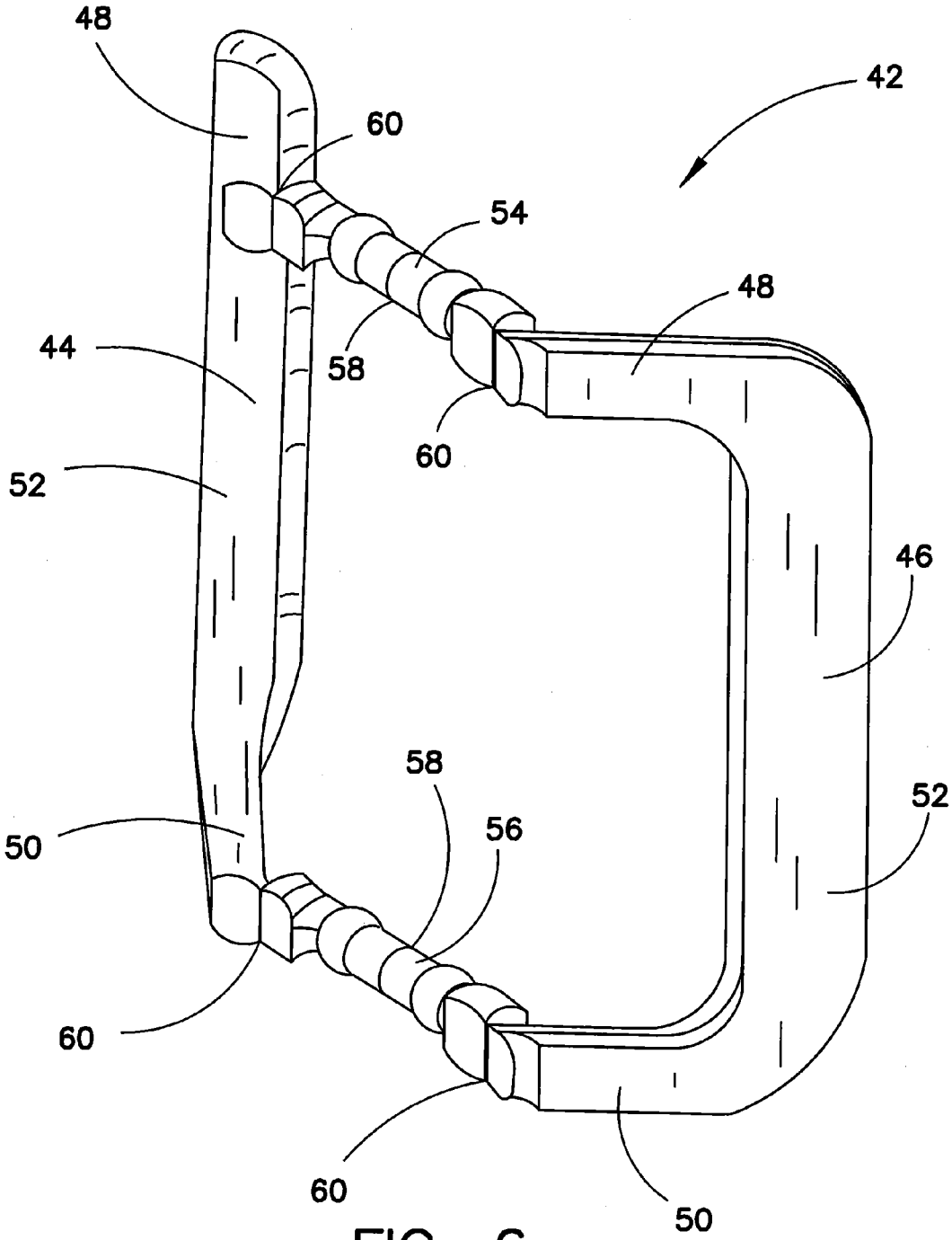
FIG. 6 is a perspective view of a handle adapted to be coupled to the bottle of the previous FIGs.
Figure 7:
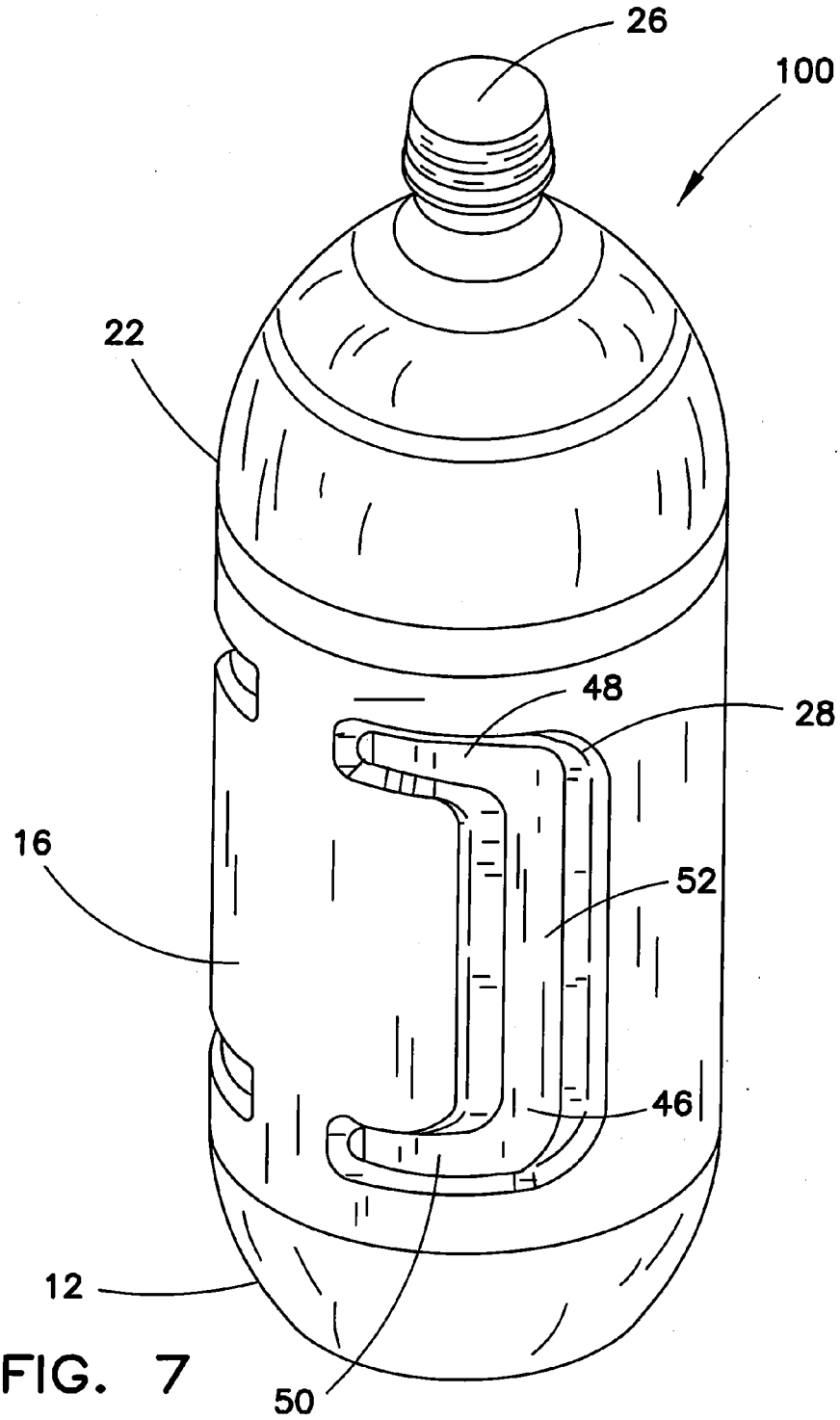
FIG. 7 is a perspective view of a container formed by the addition of the handle of FIGS. 4-6 to the bottle of FIGS. 1-3.
Figure 8:
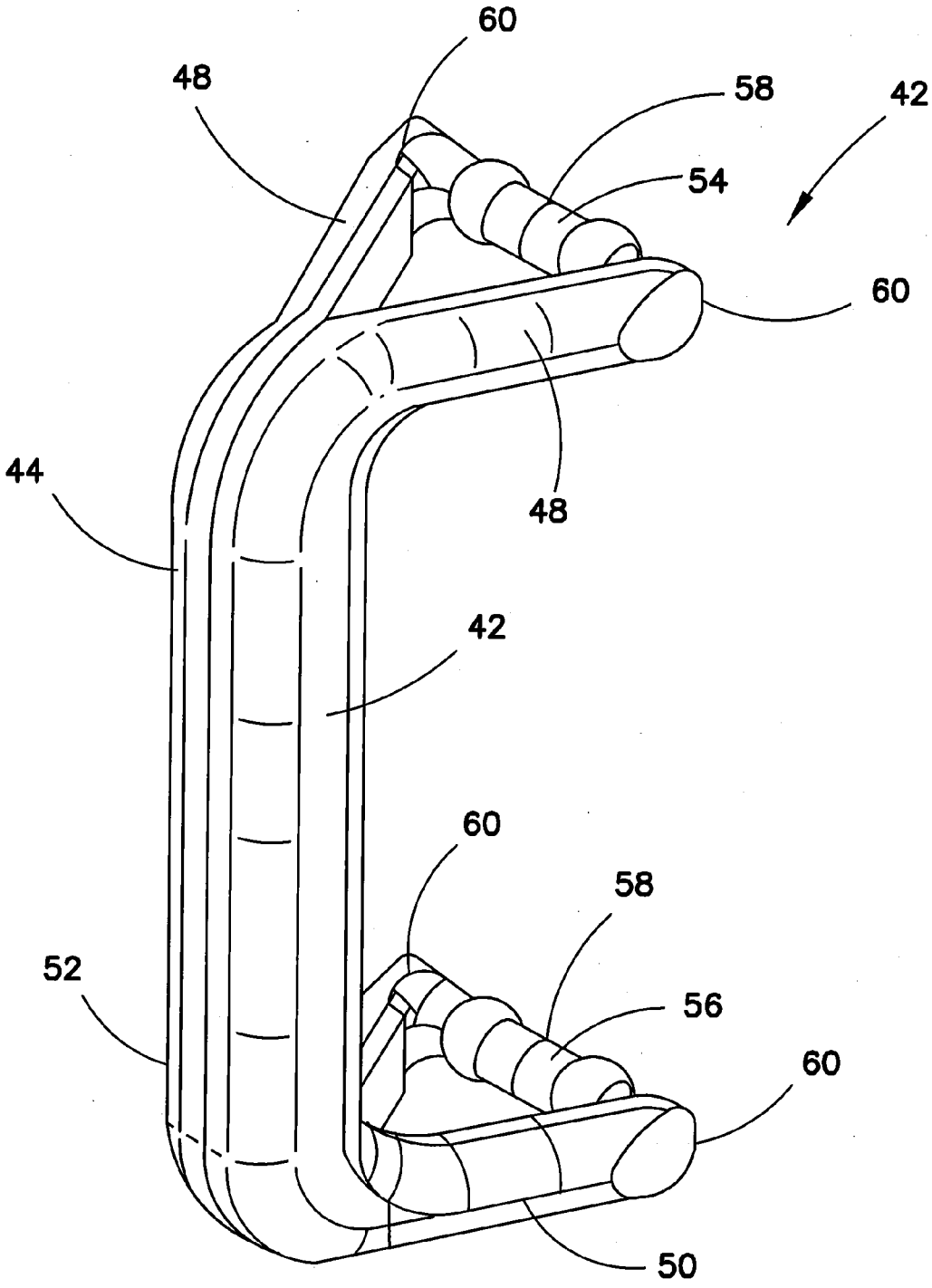
FIG. 8 is a perspective view of the handle adapted to be coupled to the bottle of the previous FIGs, the handle being folded along hinge lines to an outwardly projecting position.
Figure 9:
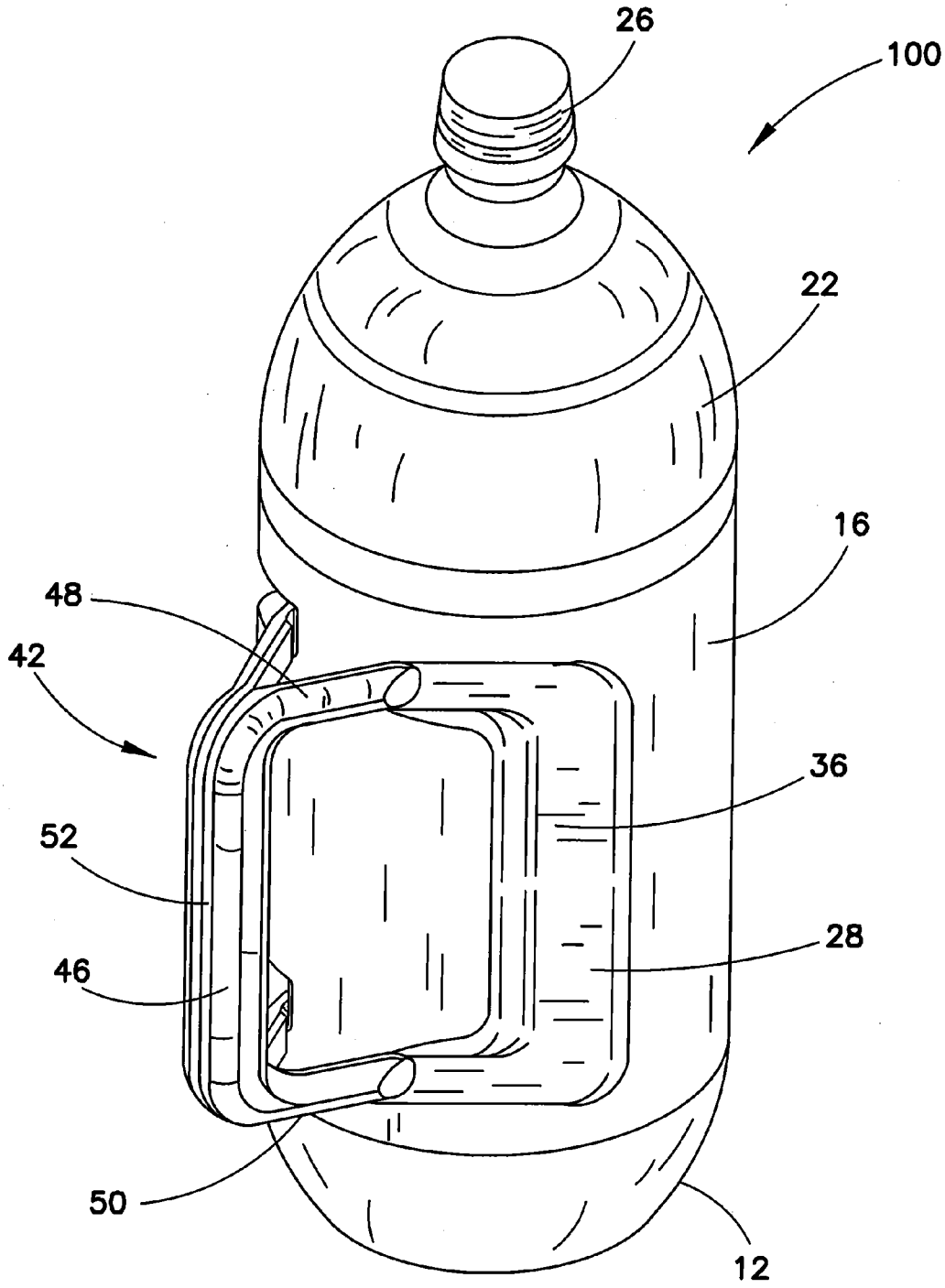
FIG. 9 is a perspective view similar to FIG. 7 with the handle folded to the outwardly projecting position.

A handle 42 is shown in FIGS. 4-6 that is suitable for use in conjunction with the bottle 10 to form a container of the present invention. The handle 42 can include a first portion 44 and second portion 46. The first and second portions 44, 46 can be suitably dimensioned to be received wholly within the pair of recesses 28, 30 in the sidewall 16 of bottle 10 as shown in FIG. 7 to form a container 100. The first and second portions 44, 46 can each include an upper portion 48, a lower portion 50, and a middle portion 52 that can join the upper and lower portions into a one-piece unitary formation. Connecting upper portions 54 can be provided to connect each of the adjoining upper portions 48. Likewise, lower connecting portions 56 can be provided to connect each of the adjoining lower portions 50. The connecting portions 54, 56 can include a separable junction 58 that will permit the connecting portions to extend through at least one of the passages 38, 40 to connect the first and second handle portions 44, 46 to each other. The connecting portions 54, 56 can include at least one hinge 60 permitting the first and second handle portions 44, 46 to be displaced from within the sidewall recesses 28, 30 of container 100, as shown in FIG. 7, to a projecting position as shown in FIGS. 8 and 9. The handle 42 is seen in FIG. 9 to project outward from the sidewall 16 sufficiently to permit the first and second portions 44, 46 to be grasped in one hand by a user of the container 100.

Figure 10:
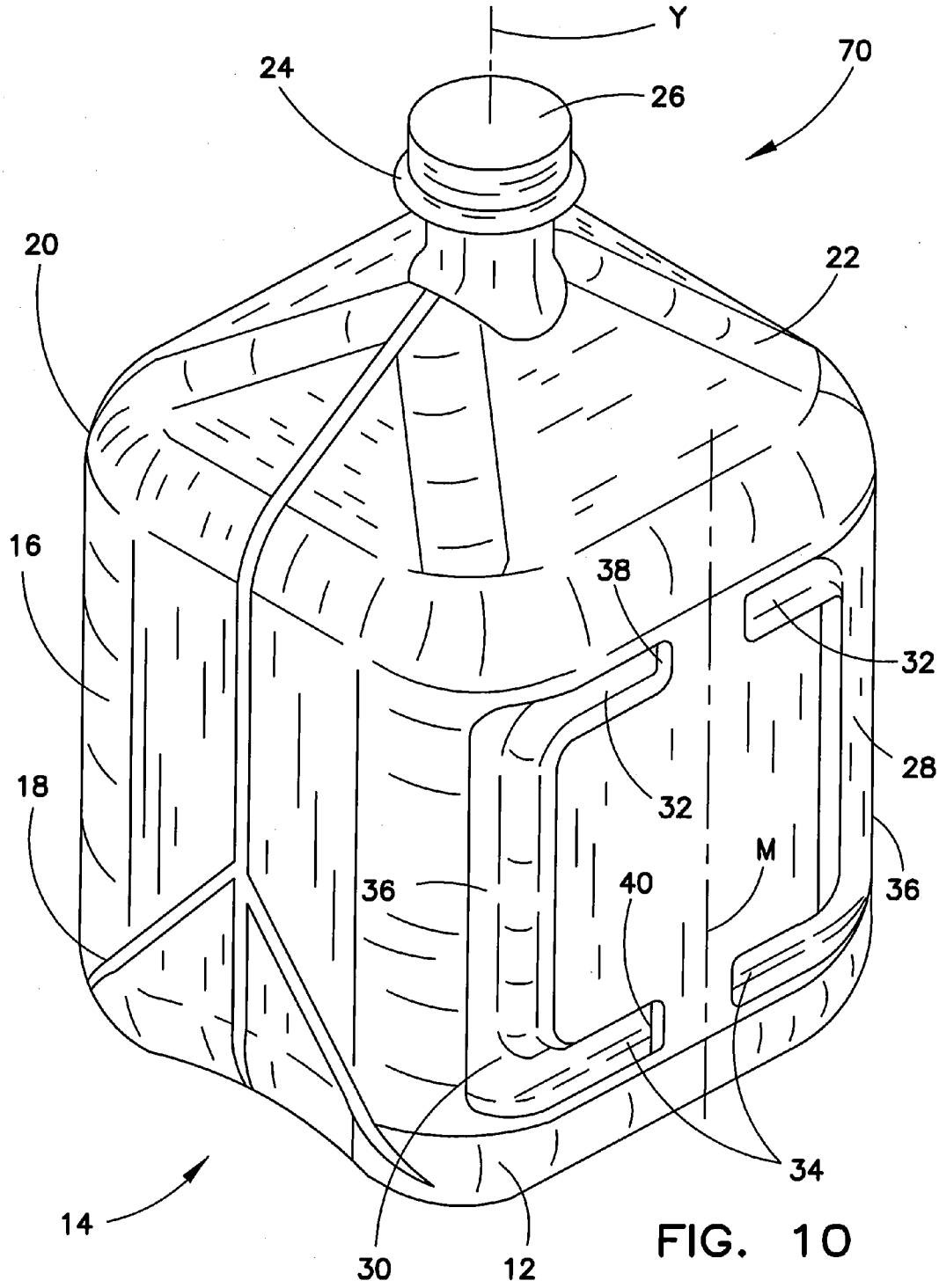
FIG. 10 is a perspective view of another bottle including recesses adapted to receive handle portions.
Figure 11:
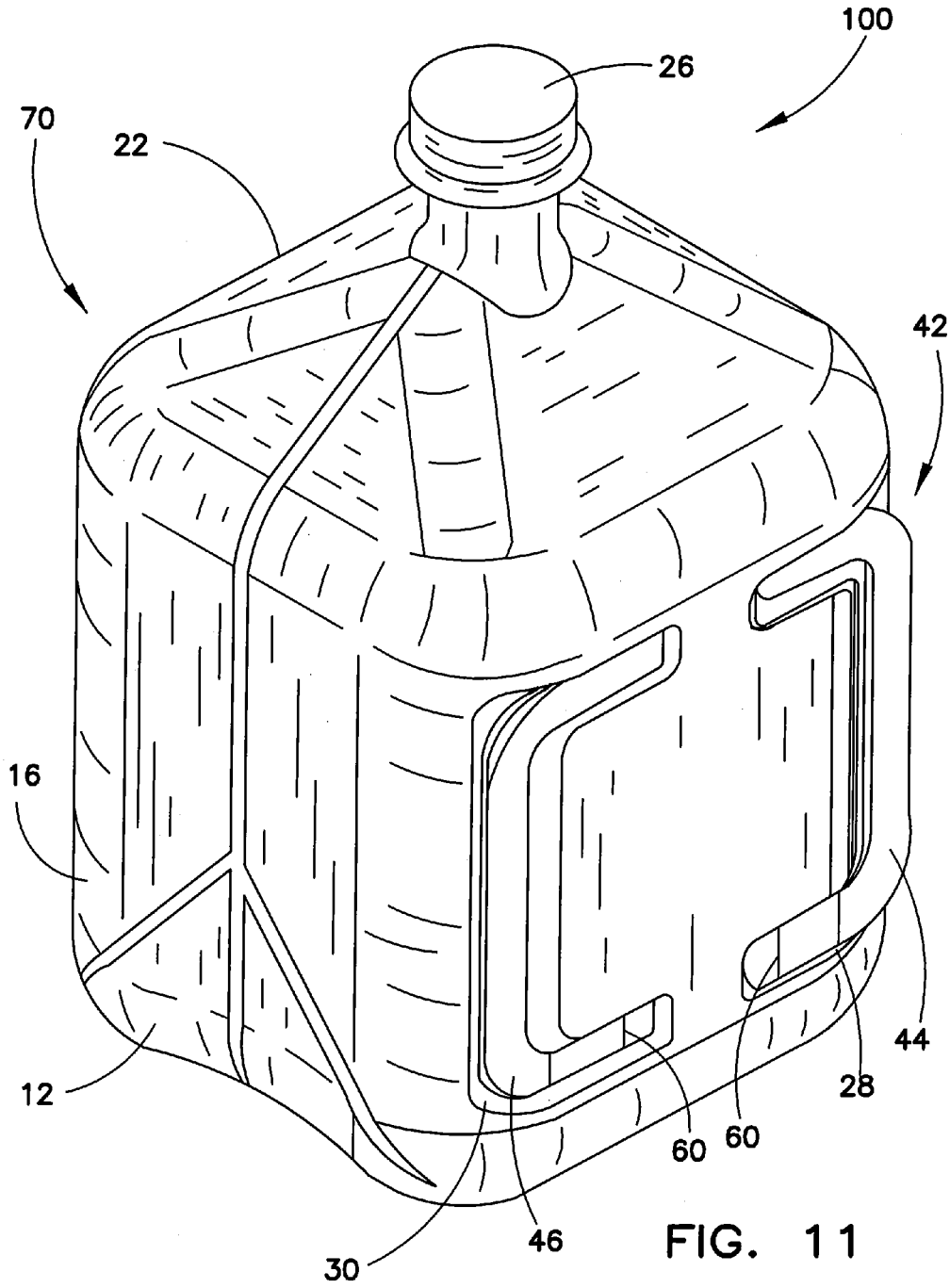
FIG. 11 is a perspective view of a container formed by the bottle of FIG. 10 and a handle similar to that shown in FIG. 4-6.
Figure 12:
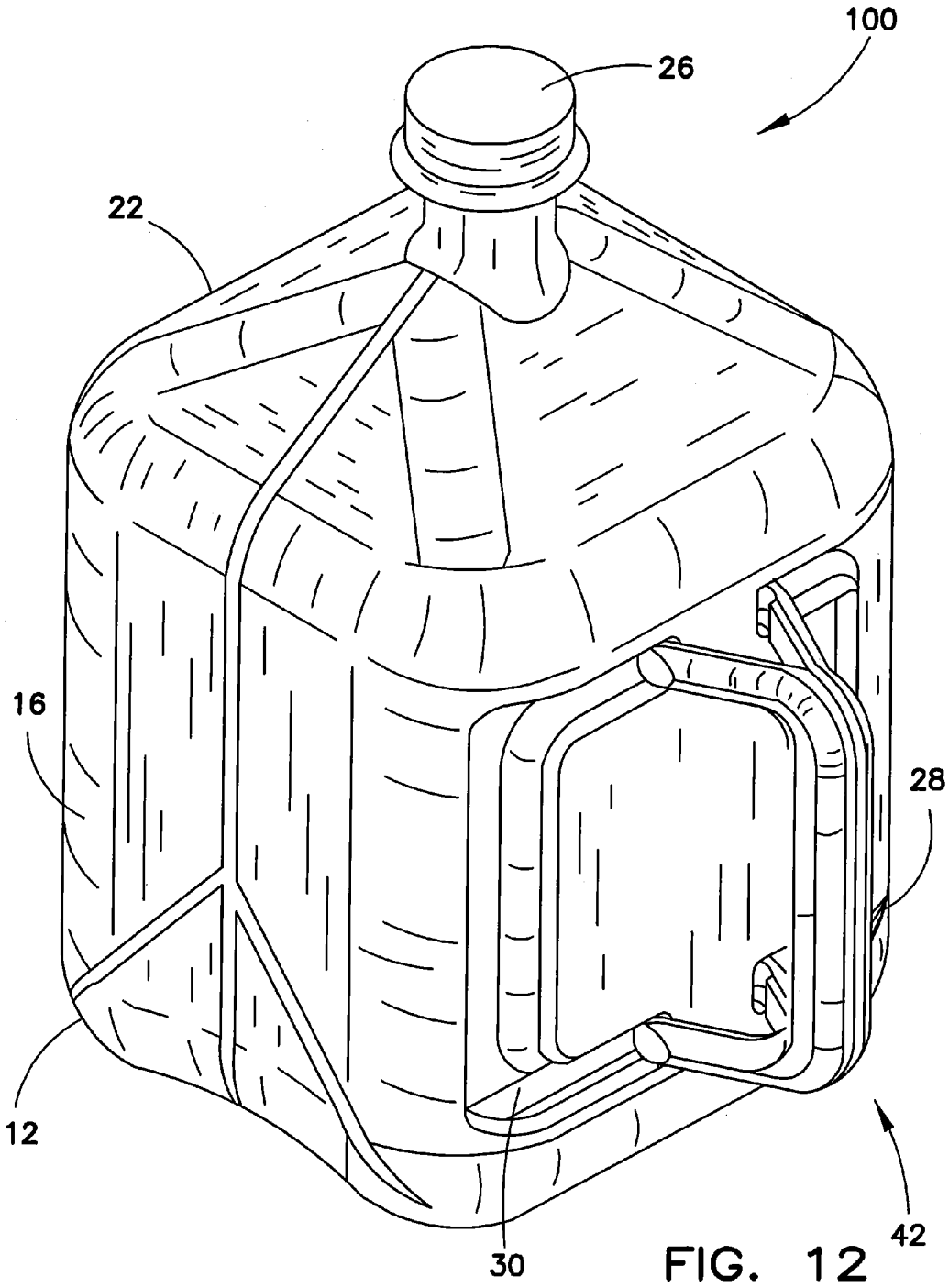
FIG. 12 is a perspective view of the container of FIG. 11 with the handle folded to the outwardly projecting position.

Another embodiment of a container 100 is shown in FIGS. 10-12, wherein the bottle 70 can include a base 12. A sidewall 16 can extend upward from the base 12. The sidewall 16 can include a lower margin 18 that is continuously joined to the base 12, and an upper margin 20. A shoulder 22 can be continuously joined to the sidewall upper margin 20 to extend upward and inward from the sidewall 16 to a finish 24 surrounding an opening into the bottle 70. The finish 24 can be threaded or otherwise adapted to receive a closure 26.

The sidewall 16 can additionally include a pair of recesses 28, 30 situated on opposite sides of a midline M, which can be vertical and arranged parallel to an axis Y of the bottle 70. The recesses 28, 30 are shown to be indentations into the sidewall 16 including an upper leg 32, a lower leg 34 and a middle portion 36 forming a continuous trough in the sidewall 16. A passage 38 can extend between inner ends of the pair of upper legs 32 of the recesses 28, 30. Another passage 40 can extend between inner ends of the pair of lower legs 34 of the recesses 28, 30. The passages 38, 40 can be defined by inserts around which the bottle 70 is molded. The passages 38, 40 can be completely surrounded or only partially surrounded by the plastic forming the sidewall 16 of the bottle 70. When the bottle 70 is formed by an extrusion-blow molding process of polymers adapted to such processing, the passages 38, 40 between the pair of recesses 28, 30 can be formed by a pinch-mold portion that defines a seam surrounding the passage generally in alignment with the mid-line M between the recesses 28, 30.

A handle 42 similar to that shown in FIGS. 4-6 and that is suitable for use in conjunction with the bottle 70 can be used to form a container 100 as shown in FIGS. 11 and 12. The first and second portions 44, 46 of handle 42 can be suitably dimensioned to be received wholly within the pair of recesses 28, 30 in the sidewall 16 of bottle 70 as shown in FIG. 11. The handle 42 can include at least one hinge 60 permitting the first and second handle portions 44, 46 to be displaced from within the sidewall recesses 28, 30 of container 100, as shown in FIG. 11, to a projecting position as shown in FIG. 12. The handle 42 is seen in FIG. 12 to project outward from the sidewall 16 sufficiently to permit the first and second portions 44, 46 to be grasped in one hand by a user of the container 100.

While these features have been disclosed in connection with the illustrated preferred embodiments, other embodiments of the invention will be apparent to those skilled in the art that come within the spirit of the invention as defined in the following claims.

The invention claimed is:

1. A container comprising:

a bottle enclosing a prescribed volume including a base, a sidewall extending upward from the base, a shoulder extending upward and inward from the sidewall to a finish surrounding an opening into the bottle, the finish being adapted to receive a closure, the sidewall including a pair of recesses situated on opposite sides of a vertical midline, and at least one passage extending between the pair of recesses, the at least one passage being defined by a seam produced by a pinch mold; and a handle including first and second portions adapted to be received wholly within the pair of recesses in the sidewall, connecting portions extending through the at least one passage to connect the first and second handle portions to each other, the connecting portions including a hinge permitting the first and second portions to be displaced from within the sidewall recesses to a position projecting outward from the sidewall sufficiently to permit the first and second portions to be grasped in one hand.

2. A container comprising:

a bottle enclosing a prescribed volume including a base, a sidewall extending upward from the base, a shoulder extending upward and inward from the sidewall to a finish surrounding an opening into the bottle, the finish being adapted to receive a closure, the sidewall including a pair of recesses situated on opposite sides of a vertical midline, and upper and lower passages extending between upper and lower ends of the recess portions; and a handle including first and second portions adapted to be received wholly within the pair of recesses in the sidewall, connecting portions extending through the at least one passage to connect the first and second handle portions to each other, the connecting portions including a hinge permitting the first and second portions to be displaced from within the sidewall recesses to a position projecting outward from the sidewall sufficiently to permit the first and second portions to be grasped in one hand.

3. The container of claim 1 or 2, wherein the vertical midline is arranged parallel to an axis of the bottle.

4. The container of claim 1 or 2, wherein the hinge comprises a pair of hinges laterally spaced from each other and located on opposite ends of the at least one passage.

5. The container of claim 2, wherein each of the first and second portions of the handle includes upper and lower portions, the upper portions of the first and second handle portions being connected to each other through the upper passage.

6. The container of claim 5, wherein the lower portions of the first and second handle portions are connected to each other through the lower passage.

7. The container of claim 2, wherein the upper and lower passages are defined by an insert molded into the bottle.

8. A container comprising:

a bottle enclosing a prescribed volume including a base, a sidewall extending upward from the base, a shoulder extending upward and inward from the sidewall to a finish surrounding an opening into the bottle, the finish being adapted to receive a closure, the sidewall including a pair of recesses situated on opposite sides of a vertical midline, the recesses including confronting upper and lower ends, and a passage extending between each the confronting pairs of upper and lower ends of the recesses; and a handle including first and second portions adapted to be received wholly within the pair of recesses in the sidewall, each of the first and second portions including upper and lower ends, connecting portions extending through the passages to connect the upper ends of the first and second handle portions to each other and the lower ends of the first and second handle portions to each other, the connecting portions including a hinge permitting the first and second portions to be displaced from within the sidewall recesses to a position projecting outward from the sidewall sufficiently to permit the first and second portions to be grasped in one hand.

9. The container of claim 8, wherein each of the passages is defined by an insert molded into the bottle.

10. The container of claim 8, wherein each of the passages is defined by a seam produced by a pinch mold.

11. The container of claim 8, wherein the hinge comprises a pair of hinges laterally spaced from each other and located on opposite ends of each of the passages.

12. The container of claim 8, wherein the vertical midline is arranged parallel to an axis of the bottle.

13. The container of claim 12, wherein the vertical midline is arranged coincident with a parting line of the mold for the bottle.

* * * * *